US005205363A

United States Patent [19]

Pascale

[11] Patent Number: 5,205,363

[45] Date of Patent: Apr. 27, 1993

[54] PORTING SYSTEM FOR PNEUMATIC IMPACT HAMMER

[76] Inventor: Jack H. Pascale, P.O. Box 371, Bloomsbury, N.J. 08804

[21] Appl. No.: 701,668

[22] Filed: May 16, 1991

[51] Int. Cl.[5] ..... B23Q 5/033

[52] U.S. Cl. ..... 173/17; 173/204; 175/92

[58] Field of Search ..... 173/14, 15, 16, 17, 173/116, 201, 202, 204, 128; 91/234; 175/92, 296

[56] References Cited

U.S. PATENT DOCUMENTS

| | | | |
|---|---|---|---|
| 3,193,024 | 7/1965 | Cleary . | |
| 3,229,775 | 1/1968 | Cleary . | |
| 4,312,412 | 1/1982 | Pillow | 173/17 |
| 4,333,537 | 6/1982 | Harris et al. | 173/17 |
| 4,530,408 | 7/1985 | Toutant | 173/17 |
| 4,932,483 | 6/1990 | Rear | 175/92 |

FOREIGN PATENT DOCUMENTS

| | | | |
|---|---|---|---|
| 2219817 | 12/1989 | United Kingdom | 175/92 |

*Primary Examiner*—Frank T. Yost
*Assistant Examiner*—Allan M. Schrock
*Attorney, Agent, or Firm*—Chilton, Alix & Van Kirk

[57] ABSTRACT

A pneumatic downhole impact drill having a porting system for automatically supplying pneumatic pressure fluid from a fluid delivery tube received within a coaxial bore in the impact piston to the opposite ends of the piston operating cylinder as the piston reciprocates. The porting system comprises an annular set of equiangularly spaced outlet ports in the fluid delivery tube and two sets of radially extending bores in the piston having first and second, axially spaced, annular sets of equiangularly spaced inlet ports which cooperate with the outlet ports in the delivery tube. The number of inlet ports in the piston in each set thereof, is different than the number of outlet ports in the supply tube and the combined angular widths of the ports of each set of inlet ports and the outlet ports is substantially greater than 360° to provide substantial fluid communication therebetween at all relative angular positions of the piston and fluid delivery tube.

26 Claims, 3 Drawing Sheets

PORTING SYSTEM FOR PNEUMATIC IMPACT HAMMER

SUMMARY OF THE INVENTION

The present invention relates generally to pneumatic impact hammers of the type having an impact piston and a fluid delivery tube received within a coaxial bore in the piston for supplying pneumatic pressure fluid to one or both ends of the piston operating chamber for and upon reciprocation of the piston.

It is a principal aim of the present invention to provide in a pneumatic impact hammer of the type described, a new and improved arrangement of cooperating passages in the fluid delivery tube and impact piston for automatically and sequentially supplying pressure fluid to one or both ends of the piston operating chamber for and upon reciprocation of the piston.

It is another aim of the present invention to provide for use in a pneumatic impact hammer of the type described, a novel and advantageous arrangement of cooperating ports in the fluid delivery tube and impact piston without undercuts in the coaxial bore in the piston.

It is a further aim of the present invention to provide in a pneumatic impact hammer of the type described, a new and improved arrangement of slots in the fluid delivery tube and drilled bores in the piston which cooperate to supply pressure fluid to one or both ends of the piston operating chamber for and upon reciprocation of the piston.

It is a further aim of the present invention to provide for use in a pneumatic impact hammer of the type described, a new and improved impact piston which can be more economically manufactured and which has a longer operating life.

Other objects will be in part obvious and in part pointed out more in detail hereinafter.

A better understanding of the invention will be obtained from the following detailed description and the accompanying drawings of an illustrative application of the invention.

DESCRIPTION OF THE PREFERRED EMBODIMENT

Figure 1A:
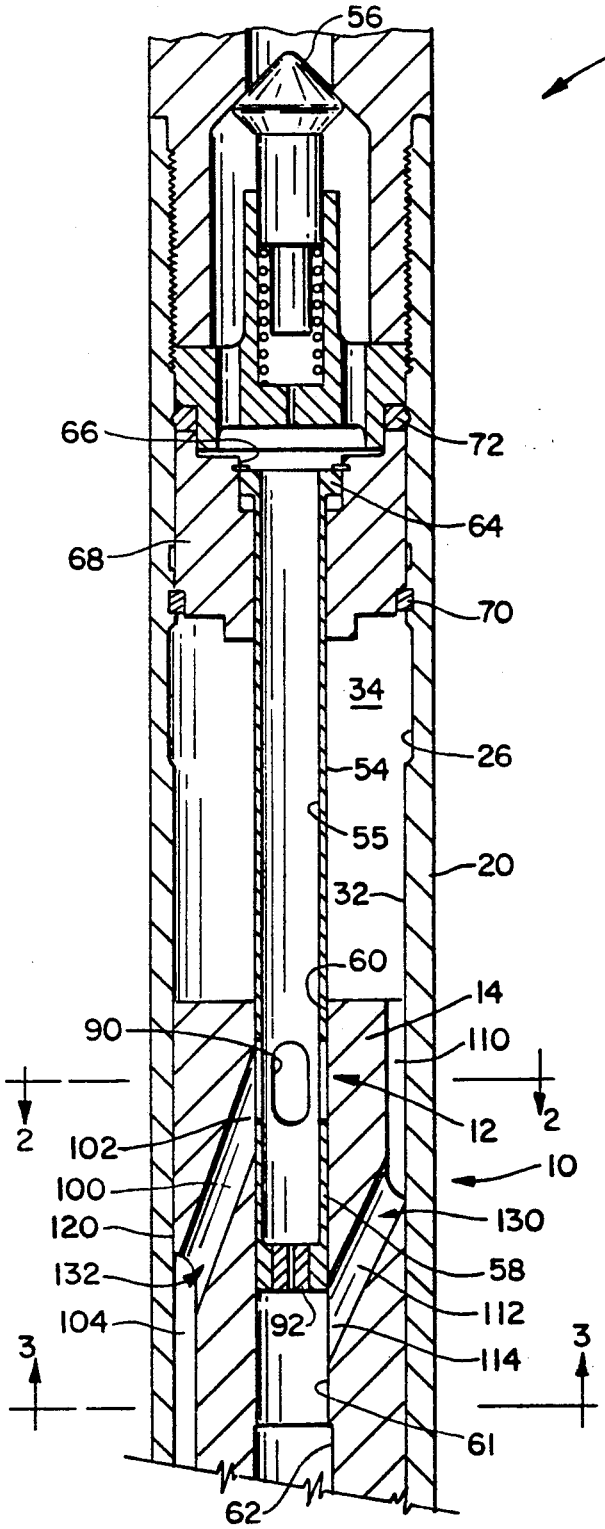
FIGS. 1A and 1B together provide a longitudinal section view, partly broken away and partly in section, of a downhole impact drill incorporating an embodiment of the present invention and showing an impact piston of the drill in a lower or impact position thereof.

In the drawings, the same numerals are used to designate the same or like parts. The porting system of the present invention has notable utility in downhole impact drills. An example of a downhole impact drill of the type to which the present invention is applicable is disclosed in U.S. Pat. No. 4,530,408, dated Jul. 23, 1985 and entitled "Porting System For Pneumatic Impact Hammer". U.S. Pat. No. 4,530,408, which is incorporated herein by reference, should be referred to for any details not disclosed herein.

FIGS. 1-3, 6 and 7 show a downhole impact drill 8 having an impact hammer 10 incorporating an embodiment 12 of the porting system. The downhole hammer 10 has an impact piston 14 reciprocable and rotatable within an outer tubular casing or cylinder 20. The elongated casing 20 has a pair of axially spaced, internal annular grooves 24, 26 and an intermediate, constant diameter, cylindrical surface 32. The cylinder 20 forms a piston operating chamber 34 and the cylindrical surface 32 supports the piston 14 for reciprocation. The ID of the cylindrical surface 32 (nominally 4 inches in hammer 10) and OD of the piston 14 are closely matched by honing and grinding the parts to provide a fluid seal therebetween.

The elongated piston 14 is reciprocated to impact a drill bit 36 at high frequency for downhole percussive drilling in a well-known manner. The drill bit 36 is mounted within the lower end of the casing 20 in a conventional manner. The bit 36 is axially shiftable within the casing 20 between an upper drilling position shown in FIG. 1B and a lower blow position (not shown).

A fluid delivery tube 54 is coaxially mounted within the upper end of the cylinder 20 for supplying pneumatic pressure fluid for reciprocating the piston 14. During drilling, pressure fluid is continuously supplied to the central axial bore 55 in the tube 54 via an inlet check valve 56. The fluid is composed of air compressed up to 350 psi or more and a selected amount of lubricating oil and water coolant.

The delivery tube 54 is received within a coaxial through bore 60 in the piston 14. The bore 60 has three stepped cylindrical sections 61–63 between its tapered or flared end openings. The OD of a lower, elongated, constant diameter, external sealing section 58 of the delivery tube 54 (nominally 1½ inches in hammer 10) and the ID of an upper, elongated, constant diameter, internal sealing section 61 of the piston are closely matched by grinding and honing the parts to provide a fluid seal therebetween.

A peripheral, integral mounting flange 64 is provided at the upper end of the tube 54. The tube 54, including its mounting flange 64, is secured within a stepped coaxial bore 66 in an upper mounting hub 68. The hub 68 is firmly mounted within the upper end of the casing 20 between an inner, internal snap ring 70 and an upper compression ring 72.

For reciprocating the piston 14, the opposite ends of the piston operating chamber 34 are sequentially connected to exhaust and to receive pressure fluid from the tube 54. As the piston reciprocates, the upper or non-impact end of the chamber 34 is timely connected to exhaust and pressure fluid is timely supplied to the lower or impact end of the chamber 34 to raise or withdraw the piston 14 for a succeeding downward impact stroke. Pressure fluid is timely supplied to the upper end of the chamber 34, first to decelerate the upward movement of the piston 14 and then to actuate the piston 14 downwardly to impact the drill bit 36. Similarly, as the piston reciprocates, the lower end of the chamber 34 is timely connected to exhaust to provide for actuating the piston 14 downwardly with the fluid pressure in the upper end of the chamber 34. The exhaust connection to the lower end of the chamber 34 is provided by an upstanding exhaust tube 80 mounted within an axial bore 82 in the upper end of the drill bit 36. The exhaust tube 80 and axial bore 82 form part of an exhaust passageway 84 leading to the lower end of the bit 36. The exhaust tube 80 is received within the lowest and largest diameter section 63 of the piston bore 60. The bore section 63 is honed to receive the exhaust tube 80 and provide an effective seal therebetween.

Pressure fluid is supplied from the fluid delivery tube 54 via an annular set of three equiangularly spaced, axial slots or ports 90 located approximately at the center of the elongated sealing section 58 of the tube 54. If desired, pressure fluid is also continuously supplied to the exhaust passageway 84 to assist in removing pulverized rock particles, water, etc. from the bottom of the drilled hole. For that purpose, a plug 92 at the lower end of the tube 54 is provided with an appropriately sized hole.

Pressure fluid is supplied through the slots 90 to the lower end of the chamber 34 via an annular set of four, equiangularly spaced, radially extending bores 100 drilled in the piston 14. The bores 100 extend downwardly and outwardly from their inner end ports 102 to the upper ends of four intermediate, peripheral axial grooves 104 in the piston 14. The four axial grooves 104 are equiangularly spaced and cooperate with the lower bypass groove 24 in the casing 20 to timely supply pressure fluid to the lower end of the chamber 34.

Figure 1B:
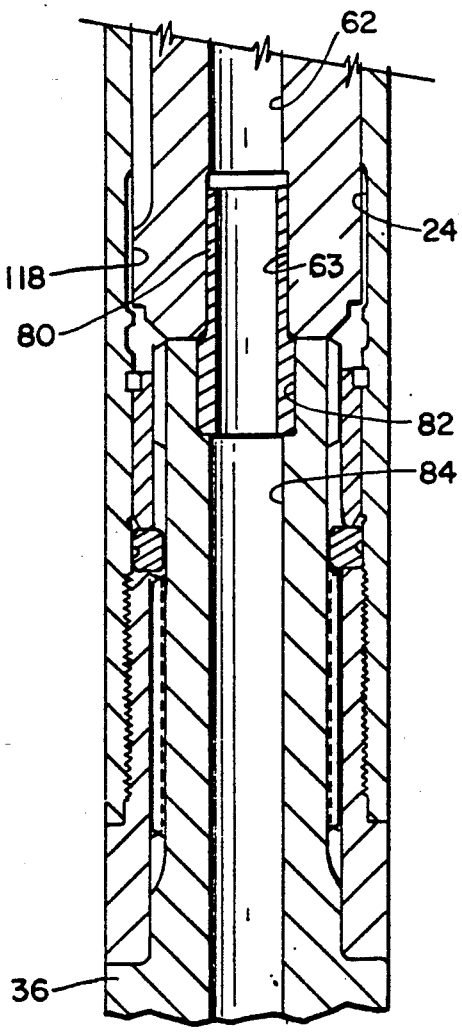
Figure 2:
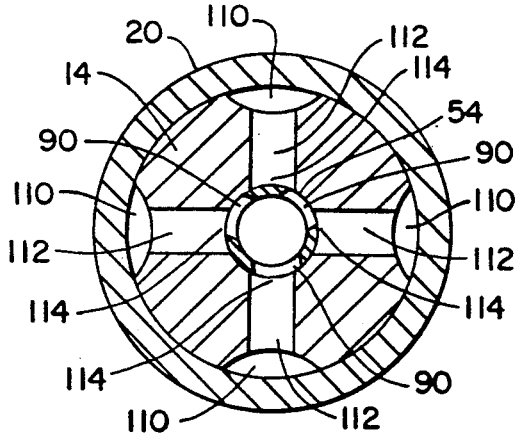
FIGS. 2 and 3 are enlarged transverse section views, partly in section, of the downhole drill taken substantially along lines 2—2 and 3—3 of FIG. 1A, showing one arrangement of ports in the piston and fluid delivery tube.
Figure 3:
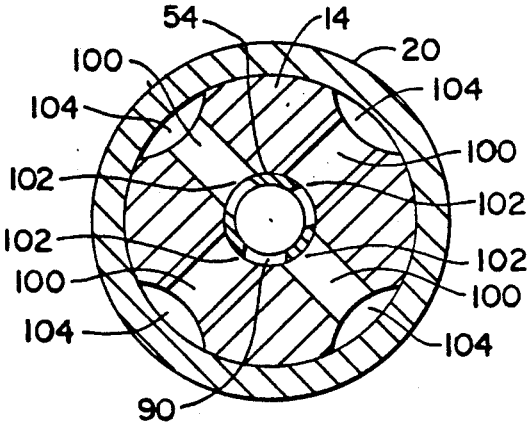

With the impact piston 14 in engagement with the drill bit 36 as shown in FIG. 1B, the upper end of the chamber 34 is connected to the exhaust passageway 84 via four, equiangularly spaced, peripheral axial grooves 110 extending downwardly from the upper end face of the piston 14. An annular set of four, equiangularly spaced, radially extending bores 112 drilled in the piston 14 connect the grooves 110 to the internal sealing section 61 of the piston 14 below the delivery tube 54. The radial bores 112 extend inwardly and downwardly from the lower ends of the peripheral axial grooves 110 to their inner end ports 114.

In the hammer 10, the eight drilled bores 100, 112 have a $\frac{5}{8}$ inch diameter, each bore 100 is drilled at an angle of 20° to the bit axis and each bore 112 is drilled at an angle of 25° to the bit axis. Each of the eight peripheral axial grooves 104, 110 has a 1 inch radius and a 1 5/16 inch width. An external, annular sealing section 118 is provided at the lower end of the piston 14 below the lower set of intermediate axial grooves 104. A second external, annular sealing section 120 is provided at the upper end of the piston 14 between the two sets of axial grooves 110, 104. The eight drilled bores 100, 112 are equiangularly spaced. Portions of the internal sealing section 61 of the piston bore are provided between the inlet ports 102, 114 of each set of ports and between the two axially spaced sets of inlet ports 102, 114. The two sets of inlet ports 102, 114 are provided between the ends of the internal sealing section 61.

Thus, an upper end passageway 130 is provided in the piston 14 by the upper set of axial grooves 110 and set of drilled bores 112 That passageway 130 is completely separate from a lower end passageway 132 in the piston 14 provided by the lower set of axial groove 104 and set of drilled bores 100.

With the impact piston 14 in engagement with the drill bit 36 as shown in FIG. 1B, pressure fluid is supplied to the lower end of the chamber 34 via the lower end passageway 132 and the upper end of the chamber 34 is connected to exhaust via the upper end passageway 130 to provide for raising or withdrawing the piston 14 from the bit 36. As the piston 14 moves upwardly, the fluid pressure connection to the lower end of the chamber 34 terminates when the upper set of inlet ports 102 moves out of registry with the slots 90. The piston 14 continues to be actuated upwardly by the pressure below the piston 14 until after the exhaust tube 80 is uncovered to connect the lower end of the chamber 34 to exhaust.

More specifically, the piston 14 moves upwardly from the drill bit 36, the inlet ports 102 of the lower end passageway 132 are first sealed off by the cooperating sealing sections 58, 61 of the delivery tube 54 and piston 14 and then the inlet ports 114 move into registry with the slots 90 to supply pressure fluid to the upper end of the chamber 34. The axial location and axial spacing of the two sets of drilled inlet ports 102, 114 and the axial length and axial position of the elongated slots 90 ar established to provide the desired timing and piston stroke.

Figure 8:
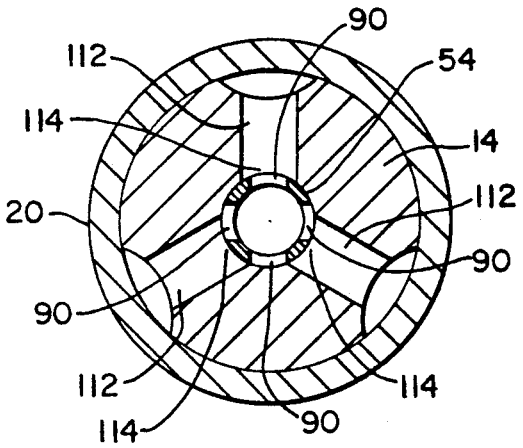
FIGS. 8 and 9 are transverse section views like FIGS. 2 and 3, showing a third arrangement of ports in the piston and fluid delivery tube.
Figure 9:
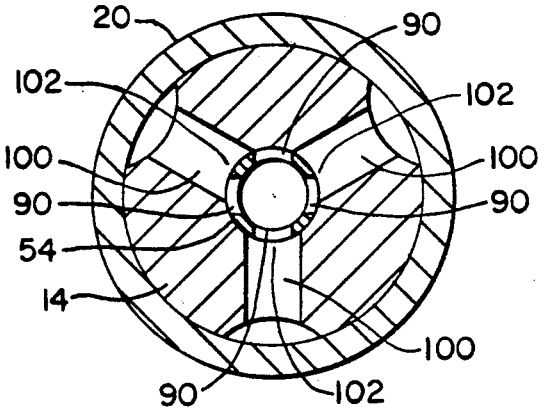

In the hammer 10, the slots 90 have an oval shape with a $\frac{5}{8}$ inch width and a $1\frac{1}{2}$ inch height. The slots 90 and inlet ports 102, 114 are sized to provide good fluid communication at all relative angular positions of the piston 14 and tube 54. FIGS. 8 and 9 show the relationship of one set of inlet ports 114 with the supply ports 90 at two different relative angular positions.

In the hammer 10, each passageway 130, 132 in the piston 14 has a larger number of inlet ports 102 or 114 than slots 90 in the tube 54. The tube 54 has an odd number of three slots 90 and each passageway 130, 132 in the piston 14 has four inlet ports 102 or 114. Each slot 90 has a $\frac{5}{8}$ inch width which provides an angular opening of approximately 61° at the OD of the tube 54. Each inlet port 102, 114 also has a $\frac{5}{8}$ inch width which provides an angular opening of approximately 61°.

With the described arrangement, approximately 67% of the total 183° angular width of the three slots 90 is uncovered at all relative angular positions of the piston 14 and tube 54. Therefore, relatively uniform communication is achieved without providing undercuts in the piston bore 60, for example as provided in the downhole drill disclosed in U.S. Pat. No. 4,530,408. Elimination of the undercuts greatly simplifies the piston machining process, increases the sealing area between the two sets of inlet ports 102 and 114 and substantially reduces stress concentration within the piston. Consequently, the piston 14 can be more economically manufactured and the operating life of the piston is substantially lengthened. Also, fluid losses are reduced and the air efficiency of the hammer 10 is improved due to the improved sealing.

Although the described arrangement of an even number of four inlet ports 102 or 114 in the piston and an odd number of three outlet ports 90 in the delivery tube 54 is the preferred arrangement for a fluid delivery tube having a nominal sealing diameter of $1\frac{1}{4}$ inches, it should be appreciated that different numbers of supply ports 90 and piston ports 102 and 114 may be provided depending primarily on the diameter (i.e., sealing diameter) of the fluid delivery tube 54, fluid pressure level and desired rate of fluid delivery. The number of piston inlet ports 102 and 114 should be different than the number of supply ports 90 and the ports should be sized to provide adequate flow at all relative angular positions of the piston 14 and delivery tube 54.

Figure 4:
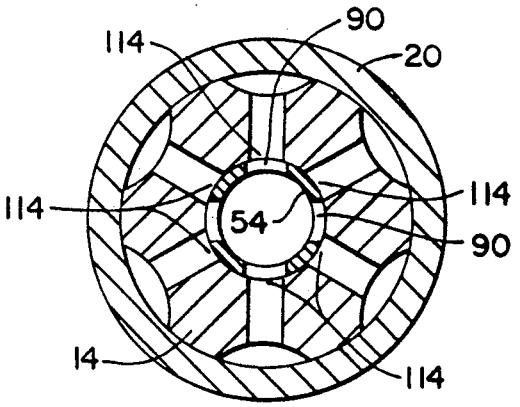
FIGS. 4 and 5 are transverse section views like FIGS. 2 and 3, showing a second arrangement of ports in the piston and fluid delivery tube.
Figure 5:
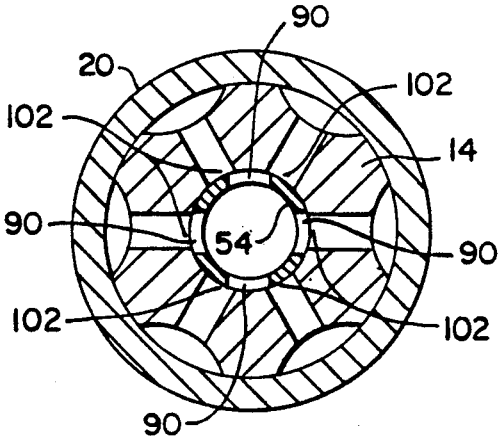
Figure 6:
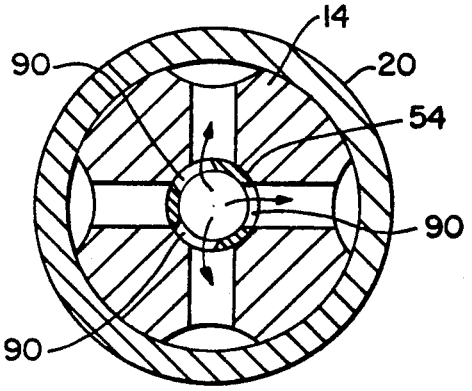
FIGS. 6 and 7 are enlarged transverse section views, partly in section, taken substantially along line 2—2 of FIG. 1A, showing the arrangement of ports in the piston and fluid delivery tube at different relative angular positions of the piston and tube.
Figure 7:
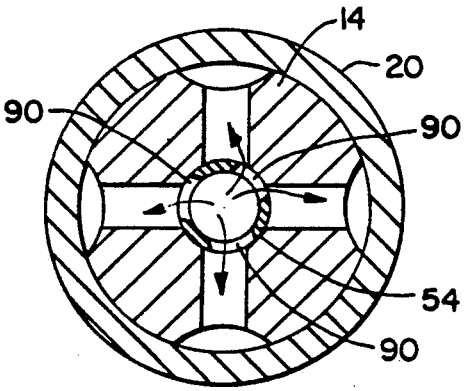

For example, with a larger diameter delivery tube 54, annular sets of six equiangularly spaced inlet ports 102 and 114 could be provided in the piston 14 and an annular set of four equiangularly spaced outlet ports 90 could be provided in the tube 54 as shown in FIGS. 4 and 5. In another example shown in FIGS. 8 and 9, annular sets of three equiangularly spaced inlet ports 102 and 114 could be provided in the piston 14 and an annular set of four equiangularly spaced outlet ports 90 could be provided in the tube 54. In this latter example, with a fluid delivery tube 54 having a nominal sealing diameter of 1¼ inches, the eight drilled bores 100, 112 preferably have a ¾ inch diameter and the supply ports 90 preferably have a ½ inch width. The piston inlet ports 102, 114 are thereby enlarged by drilling larger diameter bores 100, 112 in the piston 14. The supply ports 90 can be enlarged, for example to 77° in the hammer 10, by providing ports 90 with outwardly diverging side edges.

As will be apparent to persons skilled in the art, various modifications, adaptations and variations of the foregoing specific disclosure can be made without departing from the teachings of the present invention.

I claim:

1. In a downhole impact drill comprising an elongated cylinder providing an impact piston operating chamber, an impact piston with a coaxial through bore mounted in the cylinder for reciprocation, the operating chamber and impact piston each having non-impact and impact ends at the opposite ends of the piston, a drill bit at the impact end of the operating chamber for engagement by the impact end of the piston, the drill bit having an exhaust conduit with a coaxial exhaust tube adapted for receipt within and withdrawal from the coaxial bore in the piston at the impact end thereof for selectively connecting the impact end of the operating chamber to exhaust, and an elongated pressure fluid delivery tube mounted coaxially within the cylinder at the non-impact end of the operating chamber and extending into the coaxial bore of the piston at the non-impact end thereof, the fluid delivery tube and coaxial bore in the piston having respective external and internal, elongated, constant diameter, sealing sections in sealing engagement, the delivery tube having a set of a plurality of equiangularly spaced peripheral outlet ports in the external sealing section for the delivery of pressure fluid, the piston having first and second separate fluid passageways comprising respective first and second separate sets of radially extending bores in the piston; said first passageway, as the piston reciprocates, selectively and alternately connecting the non-impact end of the operating chamber to the outlet ports and to the exhaust conduit via said first set of radially extending bores, said second passageway, as the piston reciprocates, selectively connecting said impact end of the operating cylinder to the outlet ports via said second set of radially extending bores, the improvement wherein said first and second sets of radially extending bores have respective first and second, axially spaced, sets of a plurality of equiangularly spaced inlet ports in the internal sealing section between the ends thereof and with the internal sealing section extending around each inlet port and circumferentially between adjacent inlet ports of each set and axially between the two sets of inlet ports, said first and second sets of inlet ports cooperating with the set of outlet ports at different axial positions of the piston as the piston reciprocates to alternately supply pressure fluid from the outlet ports of the non-impact and impact ends of the operating chamber respectively, said second set of inlet ports being disposed axially closer to the non-impact end of the piston than said first set of inlet ports, the number of inlet ports in each set thereof being different than the number of outlet ports and the combined circumferential width of the ports of each set of inlet ports and the outlet ports being substantially greater than 360° to provide substantial fluid communication therebetween at all relative angular positions of the piston and fluid delivery tube.

2. A downhole impact drill according to claim 1 having four inlet ports in each set thereof and three outlet ports.

3. A downhole impact drill according to claim 1 having three inlet ports in each set thereof and four outlet ports.

4. A downhole impact drill according to claim 1 wherein each inlet port has a circumferential width of at least approximately 60° and each outlet port has a circumferential width of at least approximately 60°.

5. A downhole impact drill according to claim 1 having an even number of inlet ports in each set thereof and an odd number of outlet ports.

6. A downhole impact drill according to claim 1 having an odd number of inlet ports in each set thereof and an even number of outlet ports.

7. A downhole impact drill according to claim 1 having an even number of inlet ports in each set thereof and an even number of outlet ports.

8. An impact piston according to claim 1 wherein the total circumferential width of the inlet ports of each set thereof is at least approximately 240° and the total circumferential width of the outlet ports is at least approximately 180°.

9. In an impact piston having impact and non-impact ends at opposite axial ends thereof and a coaxial bore with an end opening at the non-impact end thereof and an elongated, internal, constant diameter, sealing section inwardly of said opening, the impact piston being adapted for use in a pneumatic impact device having a cylinder for mounting the impact piston for reciprocation and a pneumatic pressure fluid delivery tube mounted coaxially in the cylinder to extend through said end opening into the coaxial bore of the piston and having an elongated, external, constant diameter, sealing section for sealing engagement with the internal elongated sealing section of the coaxial bore of the piston and a set of a plurality of equiangularly spaced outlet ports in said external sealing section for the delivery of pressure fluid for reciprocation of the piston; the impact piston having first and second separate fluid passageways, with respective first and second separate sets of drilled, radially extending bores in the piston, for supplying pressure fluid to the opposite ends of the piston for and upon reciprocation of the piston; the improvement wherein said first and second sets of radially extending bores have first and second, axially spaced sets of a plurality of equiangularly spaced inlet ports in said internal sealing section between the ends thereof and with said internal sealing section extending around each inlet port and circumferentially between adjacent inlet ports of each set and axially between the two sets of inlet ports, the first and second sets of inlet ports being axially spaced to alternately receive pressure fluid as the piston reciprocates, the total circumferential width of the inlet ports of each set thereof being greater than 180° to provide substantial direct fluid communication with the set of outlet ports at all angular positions of the piston.

10. An impact piston according to claim 9 having four inlet ports in each set thereof.

11. An impact piston according to claim 9 wherein each inlet port has a circumferential width of at least approximately 60°.

12. An impact piston according to claim 9 wherein each of said separate fluid passageways comprises a set of equiangularly spaced, peripheral axial grooves extending axially from the corresponding set of radially extending bores respectively.

13. An impact piston according to claim 9 having the same number of inlet ports in each set thereof.

14. An impact piston according to claim 9 wherein the radially extending bores of each set thereof have the same diameter.

15. An impact piston according to claim 9 wherein the radially extending bores of each set thereof extend diagonally and have a generally oval inlet port in the internal sealing section.

16. An impact piston according to claim 9 having three inlet ports in each set thereof.

17. An impact piston according to claim 9 having six inlet ports in each set thereof.

18. In an impact piston having impact and non-impact ends at the opposite axial ends thereof and a coaxial bore with an end opening at the non-impact end thereof and an elongated, internal, constant diameter, sealing section inwardly of said opening, the impact piston being adapted for use in a pneumatic impact device having a cylinder for mounting the impact piston for reciprocation and a pneumatic pressure fluid delivery tube mounted coaxially in the cylinder to extend through said end opening into the coaxial bore of the piston and having an elongated, external, constant diameter, sealing section for sealing engagement with the internal elongated sealing section of the coaxial bore of the piston and a set of a plurality of equiangularly spaced outlet ports in said external sealing section for the delivery of pressure fluid for reciprocation of the piston; the impact piston having first and second separate fluid passageways, with first and second separate sets of drilled, radially extending bores in the piston respectively, for supplying pressure fluid to the opposite ends of the piston; the improvement wherein said first and second sets of radially extending bores have respective first and second, axially spaced, sets of a plurality of equiangularly spaced inlet ports in the internal sealing section between the ends thereof and with the internal sealing section extending around each inlet port and circumferentially between adjacent inlet ports of each set and axially between the two sets of inlet ports, the first and second sets of inlet ports being adapted to alternatively receive pressure fluid from the outlet ports for and upon reciprocation of the piston, the total circumferential width of the inlet ports of each set thereof being at least approximately 180° to provide direct fluid communication with the set of outlet ports at all angular positions of the piston.

19. An impact piston according to claim 18 having four inlet ports in each set thereof.

20. An impact piston according to claim 18 having three inlet ports in each set thereof.

21. An impact piston according to claim 18 having three inlet ports in each set thereof.

22. An impact piston according to claim 18 wherein each inlet port has a circumferential width of at least approximately 60°.

23. An impact piston according to claim 18 wherein each of said separate fluid passageways further comprises a set of equiangularly spaced, peripheral axial grooves extending axially from the corresponding set of radially extending bores respectively.

24. In an impact piston having impact and non-impact ends at the opposite axial ends thereof and a coaxial bore with an end opening at the non-impact end thereof and an elongated, internal, constant diameter, sealing section inwardly of said opening, the impact piston being adapted for use in a pneumatic impact device having a cylinder for mounting the impact piston for reciprocation and a pneumatic pressure fluid delivery tube mounted coaxially in the cylinder to extend through said end opening into the coaxial bore of the piston and having an elongated, external, constant diameter, sealing section for sealing engagement with the internal elongated sealing section of the coaxial bore of the piston and a set of a plurality of equiangularly spaced outlet ports in said external sealing section for the delivery of pressure fluid for reciprocation of the piston; the impact piston having first and second fluid passageways for supplying pressure fluid to the opposite ends of the piston for and upon reciprocation of the piston, at least one of said fluid passageways having a set of drilled radially extending bores in the piston; the improvement wherein said set of radially extending bores has a set of a plurality of equiangularly spaced inlet ports in the internal sealing section and with the internal sealing section extending around each inlet port and circumferentially between adjacent inlet ports of said set of inlet ports and in both axial directions therefrom, the total circumferential width of the inlet ports of said set of inlet ports being at least approximately 180° to provide substantial direct fluid communication with the set of outlet ports at all angular positions of the piston.

25. An impact piston according to claim 24 having at least four inlet ports in said set of inlet ports.

26. An impact piston according to claim 24 wherein each inlet port has a circumferential width of at least approximately 60°.

* * * * *

UNITED STATES PATENT AND TRADEMARK OFFICE

CERTIFICATE OF CORRECTION

PATENT NO. : 5,205,363
DATED : April 27, 1993
INVENTOR(S) : Jack H. Pascale

It is certified that error appears in the above-indentified patent and that said Letters Patent is hereby corrected as shown below:

Claim 1, column 6, line 6, change "of" to -- to --.

Claim 9, column 6, line 64, insert a comma --, -- after "spaced" (first occurrence).

Signed and Sealed this

Twenty-first Day of June, 1994

*Attest:*

Bruce Lehman

BRUCE LEHMAN

*Attesting Officer*

*Commissioner of Patents and Trademarks*